US011053820B2

(12) United States Patent
Keck

(10) Patent No.: US 11,053,820 B2
(45) Date of Patent: Jul. 6, 2021

(54) HYDRAULIC CAMSHAFT ADJUSTER

(71) Applicant: Schaeffler Technologies AG & Co. KG, Herzogenaurach (DE)

(72) Inventor: Michael Keck, OT Brunn (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/970,724

(22) PCT Filed: Jan. 11, 2019

(86) PCT No.: PCT/DE2019/100018

§ 371 (c)(1),
(2) Date: Aug. 18, 2020

(87) PCT Pub. No.: WO2019/166042

PCT Pub. Date: Sep. 6, 2019

(65) Prior Publication Data

US 2020/0386125 A1 Dec. 10, 2020

(30) Foreign Application Priority Data

Feb. 27, 2018 (DE) ..... 10 2018 104 401.1

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/34463* (2013.01);
(Continued)

(58) Field of Classification Search
CPC ..... F01L 1/3442; F01L 1/047; F01L 2001/34466; F01L 2001/34463; F01L 2001/34469; F01L 2250/02
See application file for complete search history.

(56) References Cited

U.S. PATENT DOCUMENTS

2005/0001648 A1 1/2005 Yamamoto
2005/0016481 A1 1/2005 Komazawa et al.
(Continued)

FOREIGN PATENT DOCUMENTS

DE 10217062 A1 10/2002
DE 102013224862 A1 6/2015
(Continued)

*Primary Examiner* — Zelalem Eshete
(74) *Attorney, Agent, or Firm* — Matthew V. Evans

(57) ABSTRACT

The disclosure relates to a hydraulic camshaft adjuster for the variable adjustment of the control times of gas exchange valves of an internal combustion engine, having a stator and a rotor rotatable relative to the stator. Radially inwardly projecting webs are formed on the stator and radially outwardly projecting vanes are formed on the rotor. Between the stator and the rotor are formed several hydraulic working chambers, each of which is divided into a first working chamber and a second working chamber by a vane of the rotor. Two locking elements are inserted into the rotor for the temporary, reversibly detachable fixing of the rotor relative to the stator in a middle position. The first locking element and the second locking element can be locked in a common locking slotted guide. The disclosure also relates to a method for locking of the rotor in such a hydraulic camshaft adjuster.

20 Claims, 3 Drawing Sheets

(52) U.S. Cl.
CPC ..... *F01L 2001/34466* (2013.01); *F01L 2001/34469* (2013.01); *F01L 2250/02* (2013.01)

(56) References Cited

U.S. PATENT DOCUMENTS

| | | | | |
|---|---|---|---|---|
| 2009/0250028 | A1 | 10/2009 | Fujiyoshi et al. | |
| 2010/0175650 | A1 | 7/2010 | Suzuki et al. | |
| 2011/0253087 | A1 | 10/2011 | Ikeda | |
| 2013/0186356 | A1* | 7/2013 | Schelter ..... | F01L 1/3442 123/90.15 |

FOREIGN PATENT DOCUMENTS

| | | | |
|---|---|---|---|
| WO | 2015033676 | A1 | 3/2015 |
| WO | 2015039653 | A1 | 3/2015 |

* cited by examiner

HYDRAULIC CAMSHAFT ADJUSTER

CROSS-REFERENCE TO RELATED APPLICATIONS

This application is the U.S. National Phase of PCT Application No. PCT/DE2019/100018 filed on Jan. 11, 2019 which claims priority to DE 10 2018 104 401.1 filed on Feb. 27, 2018, the entire disclosures of which are incorporated by reference herein.

TECHNICAL FIELD

This disclosure relates to a hydraulic camshaft adjuster and a method for locking a rotor of a hydraulic camshaft adjuster.

BACKGROUND

Hydraulic camshaft adjusters are used in internal combustion engines to adapt the valve timing of the intake and exhaust valves to a corresponding load condition of the internal combustion engine and thus increase the efficiency thereof. State-of-the-art hydraulic camshaft adjusters are known to work according to the vane principle. The camshaft adjuster comprises of a stator and a rotor that can be rotated relative to the stator, wherein a working chamber is formed between the stator and the rotor, which is divided into two working chambers by a vane of the rotor. The position of the rotor relative to the stator can be changed by applying a suitable hydraulic pressure to the working chambers, which allows the control times of the valves to be adjusted. The rotor is usually adjustable between a retarded and an advanced position, which are defined by corresponding stops on the stator. In addition, hydraulic camshaft adjusters are known in which the rotor can be mechanically locked in a middle position between the two stops. Well-known are hydraulic camshaft adjusters, where such a middle locking is realized by two locking bolts, which can engage in two locking slotted guides. The disadvantage of such a solution, however, is that two locking slotted guides as well as two hydraulic supply channels must be formed on the rotor in order to supply the respective locking slotted guide having pressure medium for hydraulic release, which leads to a high production effort and correspondingly high production costs.

From US 2005/0 016 481 A1 a hydraulic camshaft adjuster is known, in which two locking elements can engage in a common locking slotted guide. Two spring-loaded locking elements are thus provided on the stator of the hydraulic camshaft adjuster, which engage in a locking slotted guide formed on a radially external surface of the rotor and can thus lock the rotor relative to the stator.

A hydraulic camshaft adjuster having locking mechanism is known from DE 102 17 062 A1, where the locking element is designed as a stepped locking bolt which can lock in a locking slotted guide. The locking bolt is arranged in the rotor and can lock in the axial direction in a locking slotted guide provided on a cover of the hydraulic camshaft adjuster.

SUMMARY

The object of the disclosure is to reduce the complexity and thus the production costs of a hydraulic camshaft adjuster having two locking elements.

The object is achieved by a hydraulic camshaft adjuster for the variable adjustment of the control times of gas exchange valves of an internal combustion engine, having a stator and a rotor rotatable relative to the stator, having webs projecting radially inwards on the stator and vanes projecting radially outwards on the rotor. Several hydraulic working chambers are formed between the stator and rotor, each of which is divided by a rotor vane into a first working chamber and a second working chamber. Two locking elements are inserted into the rotor to lock the rotor in a middle position relative to the stator. It is intended that the first locking element and the second locking element can be locked in a common locking slotted guide. The proposed solution eliminates the need for a locking slotted guide compared to the solution known from the state of the art, so that simpler tools can be used to produce the locking slotted guide. In addition, less material must be removed, which reduces material wear and shortens the processing time. This reduces the production costs for the locking slotted guide. In addition, a pressure medium supply for a locking slotted guide, hereinafter also referred to as a C-channel, can be omitted on the rotor, which also reduces the production and tooling costs for the rotor.

Due to the features described herein and shown in the figures, further advantageous developments and improvements of the hydraulic camshaft adjuster are possible.

In one embodiment of the disclosure, it is provided that the locking slotted guide is formed as a stepped locking slotted guide, the locking slotted guide comprising at least a base, a middle step and a plateau, the middle step being arranged or formed between the base and the plateau. Despite a common locking slotted guide, the same number of steps for locking can be displayed as with a camshaft adjuster having two locking slotted guides. The multiple use of the locking steps in the locking slotted guide is realized in such a way that the two locking elements in the rotor are arranged very close to each other, so that one locking element can use the locking steps and stops of the other locking element in the locking slotted guide during adjustment.

In accordance with an advantageous design of the hydraulic camshaft adjuster, it is provided that both the first locking element and the second locking element are in contact with the base of the locking slotted guide when the rotor is locked in a middle position. This enables a stable and functionally reliable locking of the rotor in the middle position, as the locking elements only lift off the base when the locking slotted guide is pressurized through an appropriate hydraulic control. The control is preferably exerted through a pressure fluid pump and a central valve of the hydraulic camshaft adjuster as well as a C-channel, which connects the central valve with the locking slotted guide.

In one embodiment of the disclosure, it is provided that a first stop surface for the locking elements in the "advanced" direction and a second stop surface in the "retarded" direction are formed on the middle step. The middle step is wider than the base of the locking slotted guide. In this way, a staircase shape can be realized easily and cost-effectively in terms of production technology, against which the locking elements can rest in descending direction when turned to the middle position until the locking elements have reached the base of the locking slotted guide.

In one embodiment of the disclosure, it is provided that the locking slotted guide is formed or arranged in a locking cover of the hydraulic camshaft adjuster which limits the stator and rotor in the axial direction. A locking slotted guide in a cover can be produced easily and economically compared to a locking slotted guide in the stator or rotor. This can be achieved in particular by a forming process or a machining process, especially a milling process. Alternatively, it is possible to form the locking slotted guide by inserts which are inserted into, in particular pressed into a groove of the locking cover.

According to one embodiment of the disclosure, it is provided that the locking elements are designed as stepped locking elements, in particular as stepped locking bolts. Stepped locking elements allow both additional steps and additional functions to be implemented. The locking bolts can be in operational connection with the locking slotted guide in two different steps, once when the front face of the locking element is installed on the step and once when the locking bolt is supported on the step.

The stepped locking element can have a cylindrical base body with a diameter $D_1$ and a projection with a diameter $D_2$, preferably coaxial with the cylindrical base body, the diameter $D_1$ of the cylindrical base body being greater than the diameter $D_2$ of the projection. Such locking bolts can be produced simply and economically as turned parts or in a combination of a deep drawing process and a downstream turning process. As an alternative to a cylindrical bolt, the stepped locking element can also be designed in other shapes, for example as rectangular plates.

It is intended that a circumferential bearing surface is formed on the stepped locking elements at the transition from the cylindrical base body to the projection. An additional locking step can easily be formed by a circumferential projection, so that five instead of only three locking steps can be formed with the described locking slotted guide. The stepped locking element can rest on the plateau with the projection (1st step), rest on the plateau with the surrounding projection (2nd step), rest with the projection resting on the middle step (3rd step), rest with the perimeter projection resting on the middle step (4th step) or rest on the base with the projection (5th step). This allows smaller rotations with lower forces and/or lower torques to be used to turn the rotor step by step to the middle position.

Particular preference is given if the height of the middle step of the locking slotted guide and/or the height of the base is/are greater than the height of the projection on the stepped locking element. This ensures that there is sufficient space when the stepped locking element is present on the circumferential projection.

According to the disclosure, a method for locking a rotor of a hydraulic camshaft adjuster is provided, in which the locking elements successively penetrates into the locking slotted guide when the rotor is rotated from an adjustment position to the middle position, whereby a rotation of the rotor in the direction of the middle position is possible and a rotation of the rotor is blocked against the rotation to the middle position. Having two locking elements and only one common locking slotted guide for the two locking elements, it is possible to create a locking process that allows the advantages of the well-known locking process with two locking slotted guides at lower production costs.

BRIEF DESCRIPTION OF THE DRAWINGS

In the following, the disclosure is explained by means of different embodiments with reference to the attached figures. Identical components or components with the same function are marked with the same reference symbols. Herein.

DETAILED DESCRIPTION OF THE EMBODIMENTS

Figure 1:
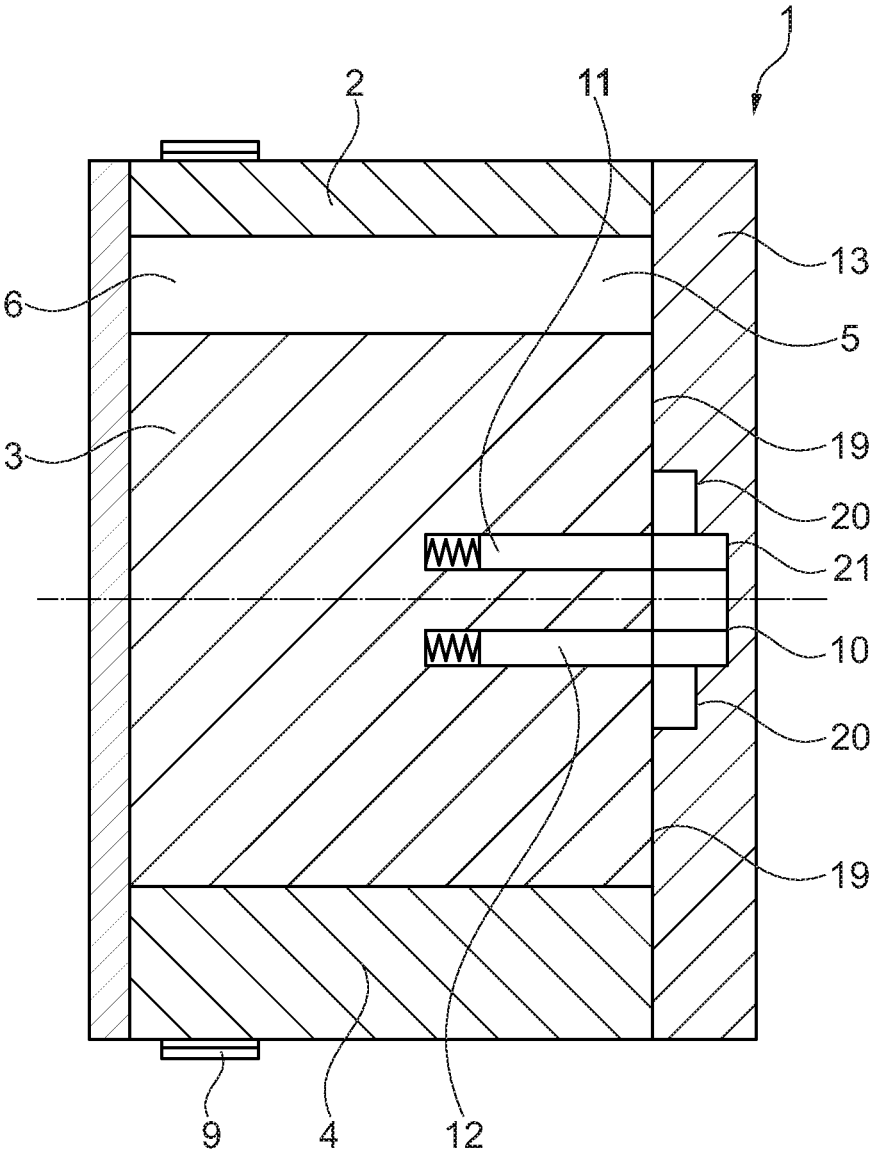
FIG. 1 shows a cross-sectional view of a hydraulic camshaft adjuster according to the disclosure.
Figure 2:
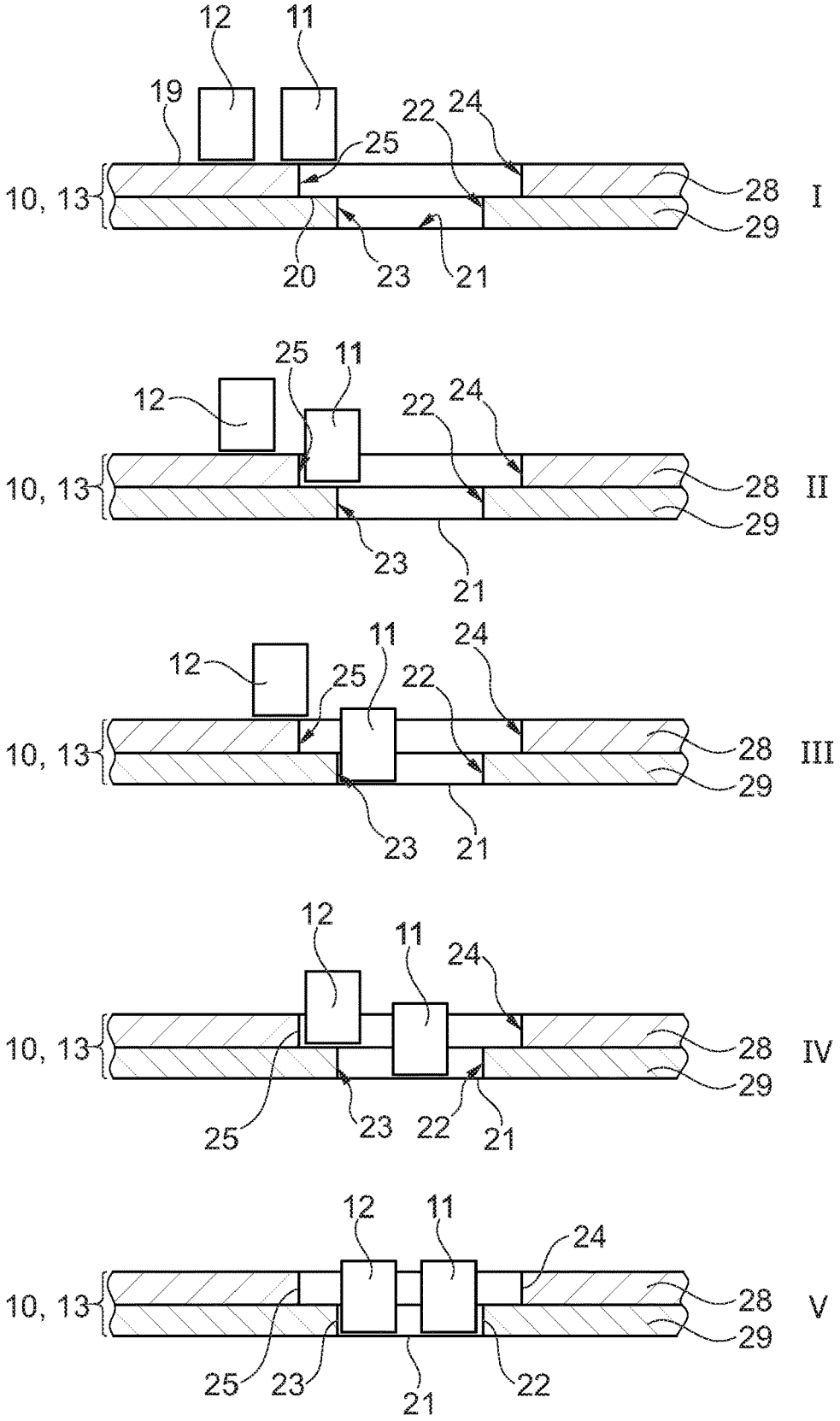
FIG. 2 shows an exemplary embodiment of a locking slotted guide of a hydraulic camshaft adjuster, showing a sequential rotation to the middle position.
Figure 3:
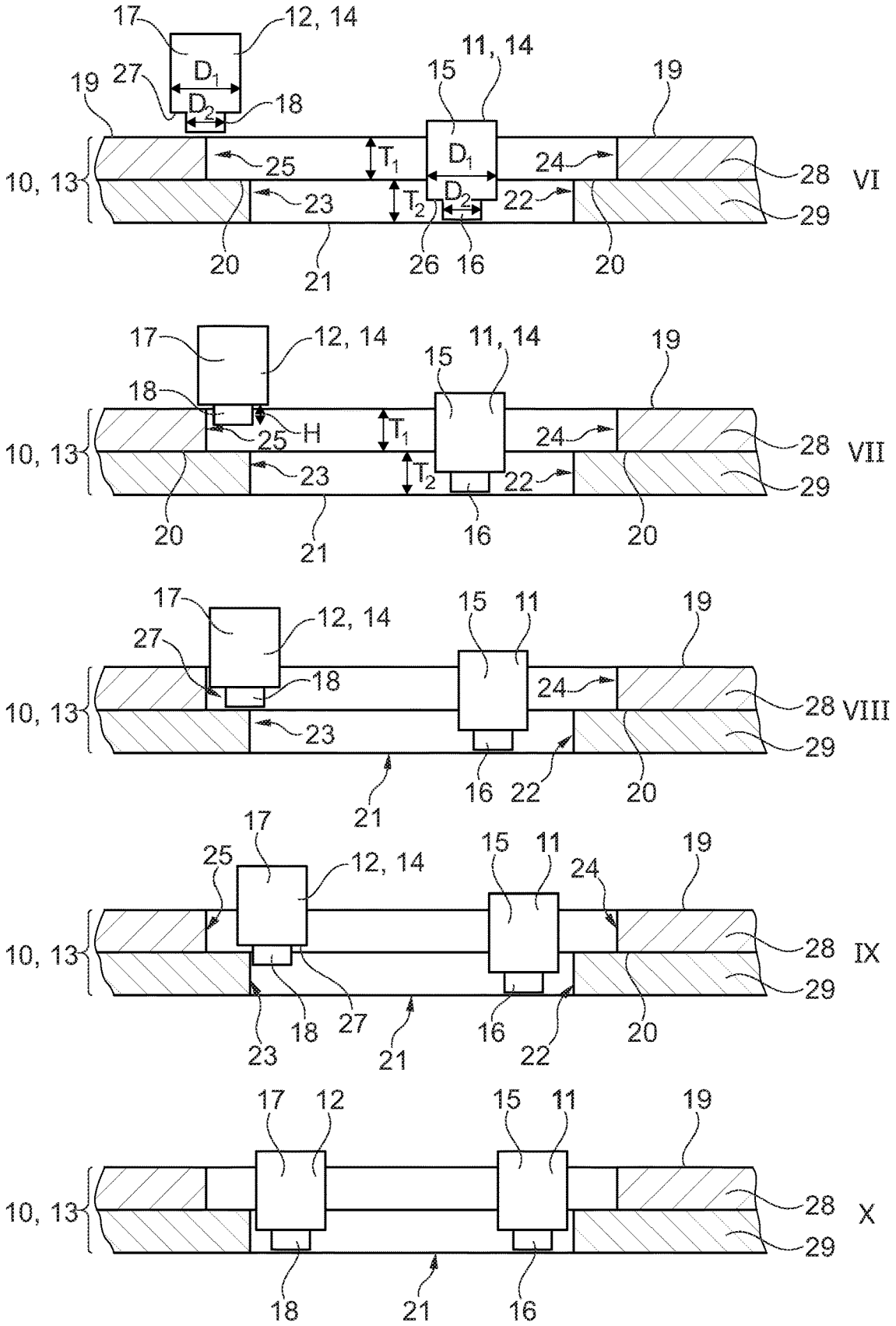
FIG. 3 shows a further exemplary embodiment of a locking slotted guide of a hydraulic camshaft adjuster, in which a successive rotation of the rotor from an adjusting position to the middle position is shown.

FIG. 1 shows a hydraulic camshaft adjuster 1 based on the vane principle having a stator 2 and a rotor 3, which can be rotated relative to stator 2. The rotor 3 is mounted in stator 2 in such a way that it can rotate around a rotation axis. The stator 2 has several webs 4, which run in a radial direction from a cylindrical base body in the direction of a central axis of the hydraulic camshaft adjuster 1. Between the rotor 3 and stator 2 are the working chambers 6, which are divided into a first and a second working chamber by vanes 5 protruding radially from a base body of the rotor 3. A drive gearing 9 is formed on the stator 2, with which the stator 2 is driven by a crankshaft of an internal combustion engine through a drive means, in particular a geared chain or belt. The stator 2 is closed at the axial end faces thereof by a cover. A locking slotted guide 10 is formed or arranged in one of the covers. The cover having the locking slotted guide 10 is also referred to in the following as locking cover 13. The locking cover 13 can be made in one or more parts. On the other hand, FIG. 2 and FIG. 3 show two-part versions of the locking cover 13, 28, 29. Alternatively, the locking slotted guide 10 can also be arranged axially between a cover of the hydraulic camshaft adjuster 1 and the stator 2. Two locking elements 11, 12 are arranged in the rotor 3, each supported by springs in a recess of the rotor 3. In addition, oil supply channels are formed on the rotor, with which the working chambers or the locking slotted guide 10 can be hydraulically controlled with a pressure medium, such as oil. The rotor 3 has a central opening into which a central valve (not shown for reasons of clarity) can be inserted to control the supply of pressure medium to the working chambers and/or the locking mechanism 10, 11, 12.

FIG. 2 shows a first exemplary embodiment of a locking process of a hydraulic camshaft adjuster 1 according having two locking elements in the rotor 3 and a common locking slotted guide 10 for the two locking elements 11, 12. The illustrated locking slotted guide 10 comprises a first locking cover 28 and a second locking cover 29. In the starting position shown, the rotor 3 of the hydraulic camshaft adjuster 1 is adjusted in the "retarded" direction. If the rotor 3 is now to be turned from this adjustment position to the middle position and locked there, a successive locking process takes place. In the initial situation I, the rotor 3 is turned so far from the middle position in the "retarded" direction that both the first locking element 11 and the second locking element 12 rest on the plateau 19 of locking slotted guide 10. When the middle locking function of the hydraulic camshaft adjuster 1 is activated, the rotor 3 is rotated by the alternating torques with the camshaft in the direction of the middle position. The first locking element 11 sinks or extends into the locking slotted guide 10 in an adjustment step II and rests on a shoulder of the middle step 20. By turning the stop 25 in the "retarded" direction, a turning back against the desired adjustment direction is blocked by the first locking bolt 11. If the rotor 3 is rotated further in the direction of the middle position by the alternating torques of the camshaft, the first locking element 11 sinks to the base 21 of the locking slotted guide 10 in an adjustment step III, while the second locking element 12 continues to rest on the plateau 19 of locking slotted guide 10. In this case, rotation against the desired direction of adjustment in the direction of the middle position is blocked by the fact that the first locking element 11 rests against a stop surface 23, which limits the base 21 in the lateral direction. In a further adjustment step IV, the second locking element 12 lowers to the middle position 20 of the locking slotted guide 10, while the first locking element 11 is turned to a middle position at the base 21 of the locking slotted guide 10. In this adjustment step IV, the blocking effect against the desired adjustment direction is achieved by the second locking element 12 resting against the stop 25 on the middle step 20 of the locking slotted guide 10. In a last adjustment step V, the second locking element 12 also sinks to the base 21 of the locking slotted guide 10. The rotor 3 is locked in this position because the first locking element 11 is in contact with the stop surface 22 and the second locking element 12 is in contact with the stop surface 23, thus blocking both rotation in the "advanced" direction and rotation in the "retarded" direction. To unlock the rotor 3, the locking slotted guide 10, in particular the base 21 of the locking slotted guide 10, can be hydraulically pressurized, whereby the locking elements 11, 12 are pressed into the rotor 3 against the force of the springs and thus release the rotation of the rotor 3. Similarly, the rotor is moved from an advanced position to the middle position, wherein during such a movement the second locking element 12 extends into the locking slotted guide 10 before the first locking element 11 or reaches the base 21 of the locking slotted guide 10 first.

FIG. 3 shows another exemplary embodiment of a locking process of a rotor 3 in a hydraulic camshaft adjuster 1. The locking slotted guide 10 is designed in two parts having a first locking cover 28 and a second locking cover 29, but can also be designed as a single piece or comprise more than two components. At a starting position VI, the rotor 3 is shifted in the "retarded" direction. The starting position in FIG. 3 corresponds essentially to adjustment step III in FIG. 2. In principle, with this design it is also possible to adjust the rotor 3 in the "retarded" direction so that the two locking elements 11, 12 rest on the plateau 19 of the locking slotted guide 10. In this exemplary embodiment, the locking elements 11, 12 are designed as stepped locking bolts 14, the stepped locking bolts 14 having a cylindrical base body 15, 17 with a first diameter $D_1$ and a projection 16, 18 with a diameter $D_2$ coaxial with the cylindrical base body 15, 17. Here, the diameter $D_1$ of the cylindrical base body 15, 17 is larger than the diameter of the respective projection 16, 18, so that a circumferential bearing surface 26, 27 results in the transition area between the cylindrical base body 15, 17 and the projection 16, 18. In the starting position VI, the projection 16 of the first locking element 11 rests on the base 21 of the locking slotted guide 10, while the projection 18 of the second locking element 12 rests on the plateau 19. In the starting position shown, the rotor 3 can be rotated freely in both adjustment directions, i.e. rotation is not blocked or hindered in this position. By turning in the direction of the middle position, the projection 18 of the second locking element 12 sinks or extends into the locking slotted guide 10 in an adjustment step VII, so that the second locking element 12 rests on the plateau with the circumferential bearing surface 27 thereof. By placing the projection 18 against the stop 25 on the middle step 20, the rotation is blocked against the desired adjustment in the direction of the middle position. In the adjustment step VIII, the second locking element 12 sinks further into the locking slotted guide 10 so that the projection 18 rests on the middle part 20, while the first locking element 11 at the base 21 of the locking slotted guide 10 is moved in the direction of the stop surface 22. In a further adjustment step IX, the circumferential bearing surface 27 of the second locking element 12 rests on the middle step 20, while the projection 18 protrudes beyond the middle step 20 in the direction of the base 21. In a final adjustment step X, the two projections 16, 18 rest on the base 21 of the locking slotted guide 10, with the rotation of the rotor being blocked by the stops 22 and 23. This locks the rotor 3 in the middle position and secures it against unwanted rotation.

In summary, it can be stated that with a hydraulic camshaft adjuster 1 according to the disclosure, it is possible to lock the two locking elements 11, 12 in a common locking slotted guide 10. This reduces the production costs for both the locking cover 13 and the rotor 3, since only one C-channel is required for the pressure medium supply of the locking slotted guide 10, thus saving one C-channel on the rotor 3.

REFERENCE CHARACTERS

1 Hydraulic camshaft adjuster
2 Stator
3 Rotor
4 Web
5 Vane
6 Workspace
9 Drive gearing
10 Locking slotted guide
11 First locking element
12 Second locking element
13 Locking cover
14 Stepped locking element
15 Base body (of the first locking element)
16 Projection (of the first locking element)
17 Base body (of the second locking element)
18 Projection (of the second locking element)
19 Plateau of the locking slotted guide
20 Middle step of the locking slotted guide
21 Base of the locking slotted guide
22 Stop surface (in the "advanced" direction)
23 Stop surface (in the "retarded" direction)
24 Stop surface (in the "advanced" direction)
25 Stop surface (in the "retarded" direction)
26 Bearing surface (on the first locking element)
27 Bearing surface (on the second locking element)
28 First locking cover
29 Second locking cover
$D_1$ Diameter of the cylindrical base body
$D_2$ Diameter of the projection
H Projection height
$T_1$ Height of the middle step
$T_2$ Height of the base

The invention claimed is:

1. A hydraulic camshaft adjuster for variable adjustment of control times of gas exchange valves of an internal combustion engine, the hydraulic camshaft adjuster comprising:

a stator having radially inwardly projecting webs;

a rotor having outwardly projecting vanes configured to be rotatable relative to the stator;

a plurality of hydraulic working chambers formed between the stator and the rotor, each of the plurality of hydraulic working chambers divided into working chambers by one of the vanes of the rotor;

a first locking element and a second locking element disposed in the rotor, the first and second locking elements configured to lock the rotor in a middle position relative to the stator; and, the first locking element and the second locking element configured to be locked in a common stepped locking slotted guide, the stepped locking slotted guide having:

a base, a middle step, and a plateau, the middle step formed between the base and the plateau;

a first stop surface in a first adjustment direction of the rotor and a second stop surface in a second adjustment direction of the rotor are formed on the middle step; and, a third stop surface in the first adjustment direction of the rotor and a fourth stop surface in the second adjustment direction of the rotor are formed on the base.

2. The hydraulic camshaft adjuster of claim 1, wherein both the first locking element and the second locking element rest against the base of the stepped locking slotted guide when the rotor is locked in the middle position.

3. The hydraulic camshaft adjuster of claim 1, wherein the stepped locking slotted guide is formed in a locking cover of the hydraulic camshaft adjuster, the locking cover configured to limit the stator and the rotor in an axial direction.

4. The hydraulic camshaft adjuster of claim 1, wherein at least one of the first or second locking elements is formed as a stepped locking element.

5. The hydraulic camshaft adjuster of claim 4, wherein:

the stepped locking element comprises a cylindrical base body with a first diameter and a projection with a second diameter formed coaxially with the cylindrical base body; and, the first diameter of the cylindrical base body is larger than the second diameter of the projection.

6. The hydraulic camshaft adjuster of claim 5, wherein a first height of the middle step and a second height of the base are greater than a height of the projection.

7. The hydraulic camshaft adjuster of claim 1, wherein:

in the first adjustment direction of the rotor, the first locking element is configured to rest against the third stop surface; and, in the second adjustment direction of the rotor, the second locking element is configured to rest against the stop surface.

8. The hydraulic camshaft adjuster of claim 1, wherein the first and second locking elements are each supported by a spring arranged within the rotor.

9. The hydraulic camshaft adjuster of claim 3, wherein the locking cover comprises a first locking cover and a second locking cover.

10. A method for locking the rotor of the hydraulic camshaft adjuster of claim 6, the method comprising:

providing:

a first stepped locking element with a first cylindrical base body and a first projection; and, the rotor in a first position so that the first stepped locking element rests on the plateau and the second locking element rests on the base;

moving the rotor in the first adjustment direction to a second position so that the second locking element rests on the base, and a first circumferential bearing surface of the first stepped locking element rests on the plateau, the first circumferential bearing surface formed by a transition area between the first cylindrical base body and the first projection;

moving the rotor in the first adjustment direction to a third position so that the first projection rests on the middle step, and the second locking element rests on the base;

moving the rotor in the first adjustment direction to a fourth position so that the first circumferential bearing surface rests on the middle step, and the second locking element rests on the base; and, moving the rotor in the first adjustment direction to a fifth position so that the first stepped locking element and the second locking element rest on the base; and, in the second, third, fourth, and fifth positions of the rotor, the rotor is blocked from moving in the second adjustment direction by at least one of the first stepped locking element or the second locking element.

11. The method of claim 10, wherein:

in the second position of the rotor, the rotor is blocked from moving in the second adjustment direction by the first projection and the second stop surface of the middle step;

in the third position of the rotor, the rotor is blocked from moving in the second adjustment direction by the first cylindrical base body and the second stop surface;

in the fourth position of the rotor, the rotor is blocked from moving in the second adjustment direction by the first projection and the fourth stop surface of the base; and, in the fifth position of the rotor, the rotor is blocked from moving in the second adjustment direction by the first cylindrical base body and the fourth stop surface.

12. The method of claim 11, wherein in the fifth position of the rotor, the rotor is blocked from moving in the first adjustment direction by the second locking element.

13. A method for locking a rotor to a stator of a hydraulic camshaft adjuster, comprising:

providing the hydraulic camshaft adjuster, the hydraulic camshaft adjuster having:

a plurality of working chambers formed between outwardly projecting vanes of the rotor and radially inwardly projecting webs of the stator; and, a first locking element and a second locking element disposed in the rotor, the first and second locking elements configured to lock the rotor in a middle position relative to the stator; and, the first locking element and the second locking element configured to be locked in a common stepped locking slotted guide, the stepped locking slotted guide having a base, a middle step, and a plateau, the middle step formed between the base and the plateau;

providing the rotor in a first position so that the first and second locking elements rest on the plateau of the stepped locking slotted guide;

moving the rotor in a first adjustment direction to a second position so that the first locking element rests on the middle step of the stepped locking slotted guide;

moving the rotor in the first adjustment direction to a third position so that the first locking element rests on the base;

moving the rotor in the first adjustment direction to a fourth position so that the second locking element rests on the middle step and the first locking element rests on the base;

moving the rotor in the first adjustment direction to a fifth position so that both the first and second locking elements rest on the base; and, in the second, third, fourth, and fifth positions of the rotor, the rotor is blocked from moving in a second adjustment direction by at least one of the first or second locking elements.

14. The method of claim 13, wherein:

in the second position of the rotor, the rotor is blocked from moving in the second adjustment direction by the first locking element and a first stop surface of the middle step;

in the third position of the rotor, the rotor is blocked from moving in the second adjustment direction by the first locking element and a second stop surface of the base;

in the fourth position of the rotor, the rotor is blocked from moving in the second adjustment direction by the second locking element and the first stop surface; and, in the fifth position of the rotor, the rotor is blocked from moving in the second adjustment direction by the second locking element and the second stop surface.

15. The method of claim 13, wherein the middle step is wider than the base.

16. The method of claim 13, further comprising:

providing the rotor in a sixth position so that the first and second locking elements rest on the plateau of the stepped locking slotted guide;

moving the rotor in the second adjustment direction to a seventh position so that the second locking element rests on the middle step of the stepped locking slotted guide;

moving the rotor in the second adjustment direction to an eighth position so that the second locking element rests on the base;

moving the rotor in the second adjustment direction to a ninth position so that the first locking element rests on the middle step and the second locking element rests on the base; and, moving the rotor in the second adjustment direction to a tenth position so that both the first and second locking elements rest on the base; and, in the seventh, eighth, ninth, and tenth positions of the rotor, the rotor is blocked from moving in the first adjustment direction by at least one of the first or second locking elements.

17. The method of claim 16, wherein:

in the seventh position of the rotor, the rotor is blocked from moving in the first adjustment direction by the second locking element and a third stop surface of the middle step;

in the eighth position of the rotor, the rotor is blocked from moving in the first adjustment direction by the second locking element and a fourth stop surface of the base;

in the ninth position of the rotor, the rotor is blocked from moving in the first adjustment direction by the first locking element and the third stop surface; and, in the tenth position of the rotor, the rotor is blocked from moving in the first adjustment direction by the first locking element and the fourth stop surface.

18. A hydraulic camshaft adjuster for variable adjustment of control times of gas exchange valves of an internal combustion engine, the hydraulic camshaft adjuster comprising:

a stator having radially inwardly projecting webs;

a rotor having outwardly projecting vanes configured to be rotatable relative to the stator;

a plurality of hydraulic working chambers formed between the stator and the rotor, each of the plurality of hydraulic working chambers divided into working chambers by one of the vanes of the rotor;

a first locking element and a second locking element disposed in the rotor, the first and second locking elements configured to lock the rotor in a middle position relative to the stator; and, the first locking element and the second locking element configured to be locked in a common stepped locking slotted guide, the stepped locking slotted guide having:

a base, a middle step, and a plateau; the middle step formed at each of a first end and a second end of the stepped locking slotted guide between the base and the plateau.

19. The hydraulic camshaft adjuster of claim 18, wherein:

in a first rotor position, the first and second locking elements rest on the plateau; and, when the rotor is moved in a first adjustment direction from the first rotor position to a second rotor position, the first locking element rests on a first middle step arranged at the first end of the stepped locking slotted guide and the second locking element rests on the plateau; and, in a third rotor position, the first and second locking elements rest on the plateau; and, when the rotor is moved in a second adjustment direction from the third rotor position to a fourth rotor position, the second locking element rests on a second middle step arranged at the second end of the stepped locking slotted guide and the first locking element rests on the plateau.

20. The hydraulic camshaft adjuster of claim 18, further comprising a first locking cover configured to form the plateau of the stepped locking slotted guide, and a second locking cover configured to form the base of the stepped locking slotted guide.

* * * * *